United States Patent [19]

Pellegrini Afri

[11] Patent Number: 4,979,618

[45] Date of Patent: Dec. 25, 1990

[54] ECOLOGIC CONTAINER FOR POLLUTANT MATERIALS

[75] Inventor: Givoanni Pellegrini Afri, Osoppo, Italy

[73] Assignee: Immobiliare San Remigio S.r.l., Osoppo, Italy

[21] Appl. No.: 397,268

[22] Filed: Aug. 23, 1989

[30] Foreign Application Priority Data

Apr. 13, 1989 [IT] Italy ..... 83380 A/89

[51] Int. Cl.[5] ..... B65D 88/76

[52] U.S. Cl. ..... 206/459; 220/1 B; 220/18; 220/457; 250/506.1; 405/128

[58] Field of Search ..... 40/312; 206/459; 220/1 B, 1.5, 18, 23.4, 23.6, 415, 453, 456, 457, 465, 466, 468, 1 T; 250/506.1, 507.1; 405/128, 129

[56] References Cited

U.S. PATENT DOCUMENTS

| | | | |
|---|---|---|---|
| 166,100 | 7/1875 | Heineman | 206/459 |
| 3,430,804 | 3/1969 | Bernas | 220/468 |
| 3,562,977 | 2/1971 | Alleaume | 220/454 |
| 4,229,316 | 10/1980 | Baatz et al. | 250/507.1 |
| 4,414,475 | 11/1983 | Kratz et al. | 250/507.1 |
| 4,632,602 | 12/1986 | Hovnanian | 405/128 |
| 4,784,802 | 11/1988 | Mallory et al. | 250/507.1 |
| 4,844,840 | 7/1989 | Feizollahi | 250/507.1 |
| 4,847,009 | 7/1989 | Madle et al. | 250/507.1 |

FOREIGN PATENT DOCUMENTS

| | | | |
|---|---|---|---|
| 2556711 | 6/1977 | Fed. Rep. of Germany | 220/453 |
| 3012561 | 10/1981 | Fed. Rep. of Germany | 220/453 |
| 3130578 | 3/1983 | Fed. Rep. of Germany . | |
| 3335044 | 4/1985 | Fed. Rep. of Germany . | |
| 2165132 | 8/1973 | France . | |
| 0063330 | 8/1968 | German Democratic Rep. | 220/23.4 |
| 8703564 | 6/1987 | World Int. Prop. O. . | |
| 8800915 | 2/1988 | World Int. Prop. O. . | |

*Primary Examiner*—Jimmy G. Foster

*Attorney, Agent, or Firm*—Curtis, Morris & Safford

[57] ABSTRACT

Ecologic container for pollutant and dangerous materials, characterized in that it consists:

in a prefabricated concrete structure in parallelepiped form, preferably cubic form, equipped with:

an internal chamber as a spheroidal cavity with a superior opening closable by a plug.

11 Claims, 4 Drawing Sheets

ECOLOGIC CONTAINER FOR POLLUTANT MATERIALS

The present invetion relates to an ecologic container for pollutant materials. In particular, the invention is useful for recycling of eliminating pollutant materials.

In the prior art, waste containers for pollutant materials are known. These waste containers have the inconvenience of being made of metallic materials, plastics or other materials that present limitations in the solidity or resistance against chemical or biological degradation or against acts of vandalism.

The main object of the present invention is to obviate the above-mentioned inconveniences.

This and others objects are reached and solved with the present invention as claimed, by means of an ecologic container for pollutant and dangerous materials, characterized in that it consists:

in a prefabricated concrete structure in parallelepiped form, preferably cubic form, equipped with:

an internal containing chamber in the form of a spheroidal cavity, and having a superior opening which is closable by a plug.

The container:

because of its parallelepiped form is perfectly stockable and stackable even in limitless quantity, and because of the form of the internal containing cavity, it can resist very high external pressures.

Advantageously, the container is made from reinforced concrete adequate to resist bumps, even bumps which cause the container to flip over, for example during transport.

The spheroidal internal chamber can be coated with different impermeable coating materials depending on the material to be contained. For example, the coating material used can be: a resistant varnish, glass, plastic material and reinforce plastic material, lead, stainless steel, and also layers of different materials.

Advantageously, the exterior form is cubic and the respective faces are prearranged with three ledges and three hollows in conical cog shape, to allow cog insertion of the respective ledges as male protrusions into opposed hollows as female recesses in stock/stack assembling.

The lower face is male allowing the container to be brought and moved by lifters and to perfectly fit against a superior face that is in cog female shape. The last container has the respective upper opening for the input of the material to be contained. Similarly shaped are the lateral faces allowing also horizontal stacking to improve the respective stability of the complete stack.

In the superior part, the container is further provided with two transverse grooves with two opposed ring hanging means to allow hanging and lifting of the container. The reinforced concrete can be prestressed.

To close the container, after filling it with the pollutant material, a plug made with the same material as the container, even similarly coated or preferably completely made of the material that constitutes the internal coating of the respective chamber seals the opening and is kept in place with mortar cement or other convenient sealing material.

In such a way, an ecologic container is obtained for elimination of pollutant materials. The container can be stocked, interred, sunk, Etc., without dangers of pollution.

The materials used for the construction of the container are easily available and the constructional technique is extremely simple and well known. Thus the production costs for making the container a very low.

The container is completely safe, principally because the container made from reinforced concrete is extremely resistant to high temperature, bumps and mistreament. Further, a sealed container cannot be tampered. Finally the container so made is not perishable or corrodible, and all the necessary information concerning the contained material can be placed on a plate secured to the container.

These and other advantages will appear from the successive itemized description of a preferred embodiment with the help of the enclosed drawings whose particulars are not to be intended as a limitation but only as an example.

Figure 1:
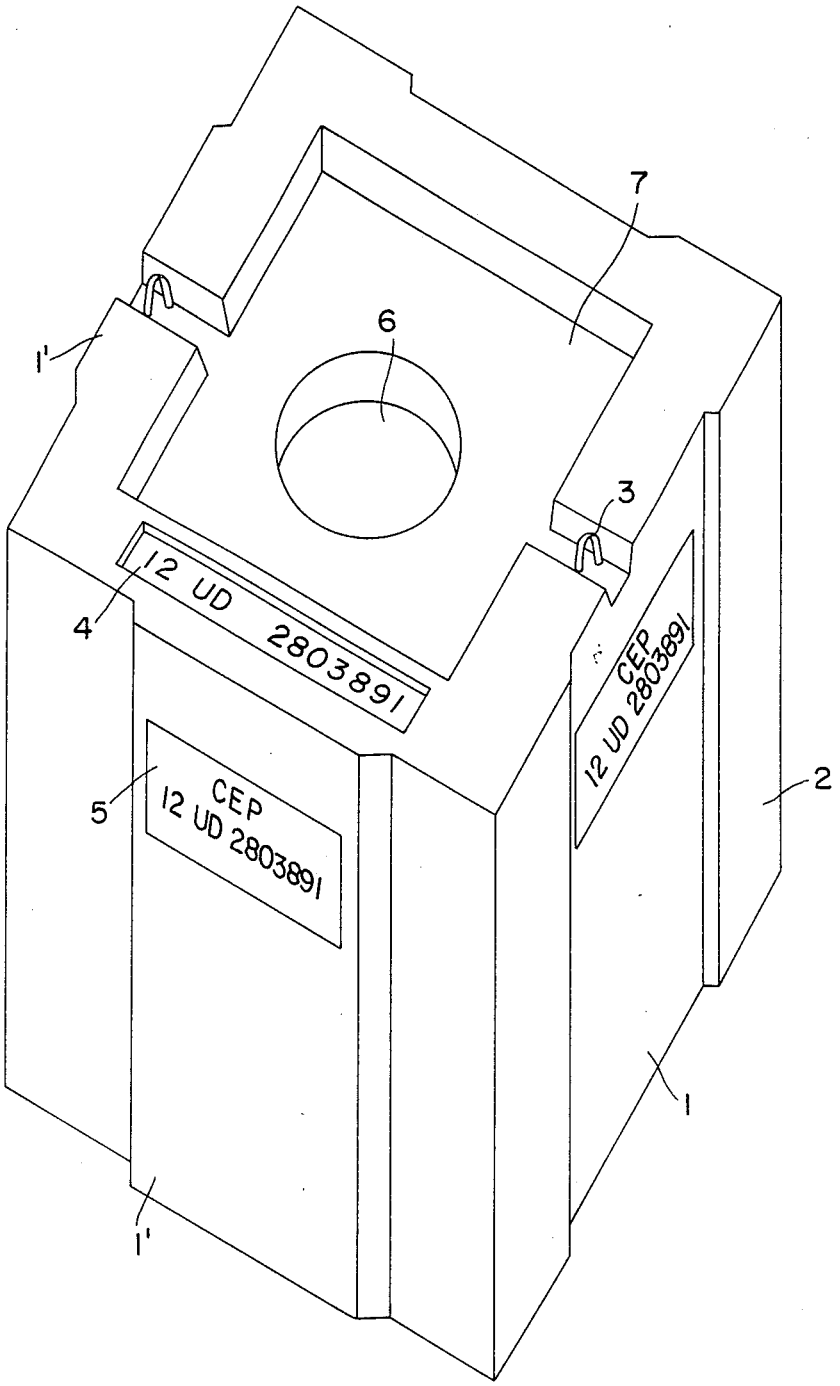
FIG. 1 represents a perspective view of the container.
Figure 2:
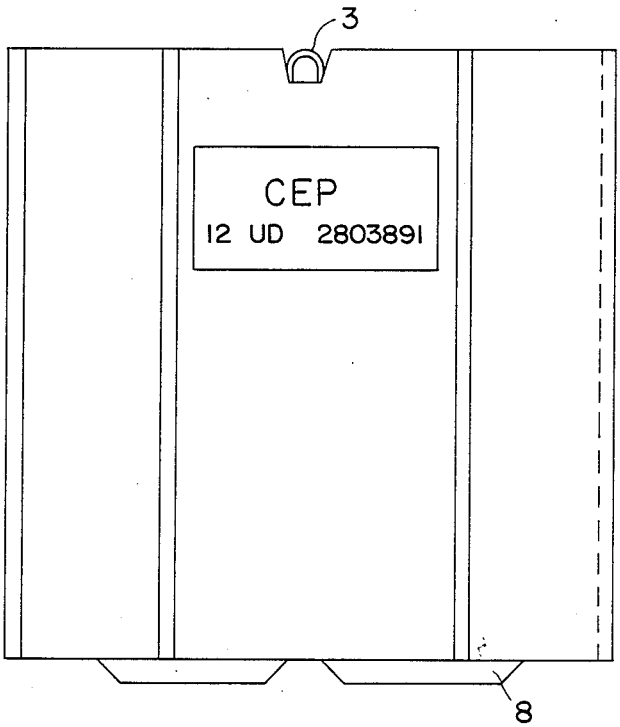
FIG. 2 represents a lateral view of the container from the side of the hanger means.
Figure 3:
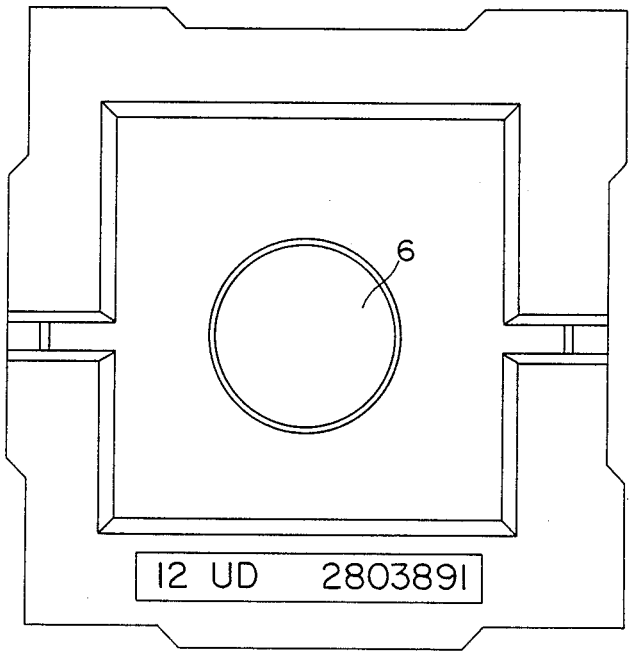
FIG. 3 represents a top view of the container.
Figure 4:
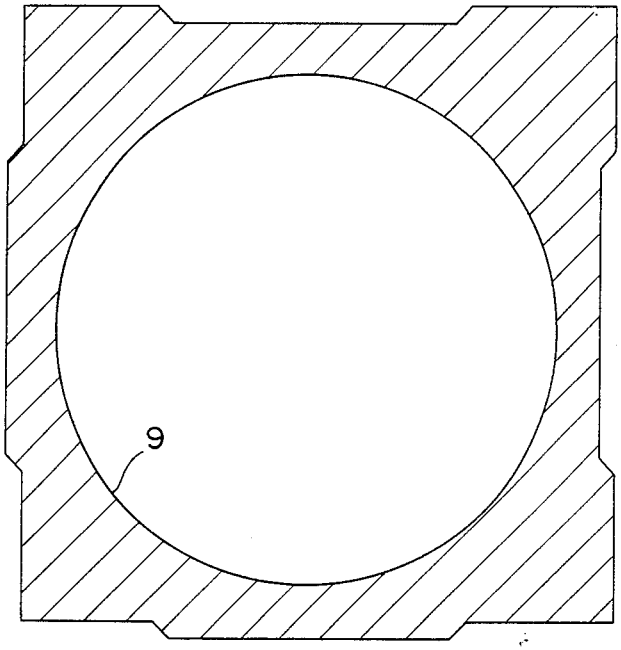
FIG. 4 represents a view in horizontal section of the container.
Figure 5:
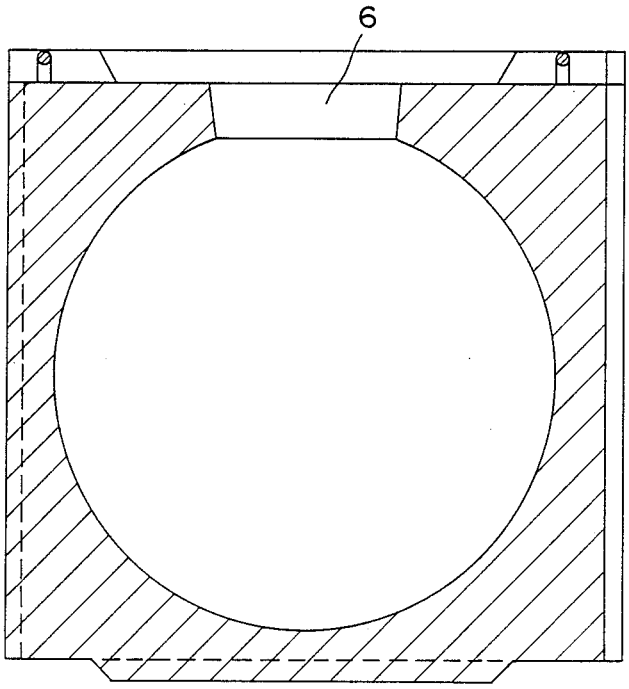
FIG. 5 represents a view in a vertical section of the container.
Figure 6:
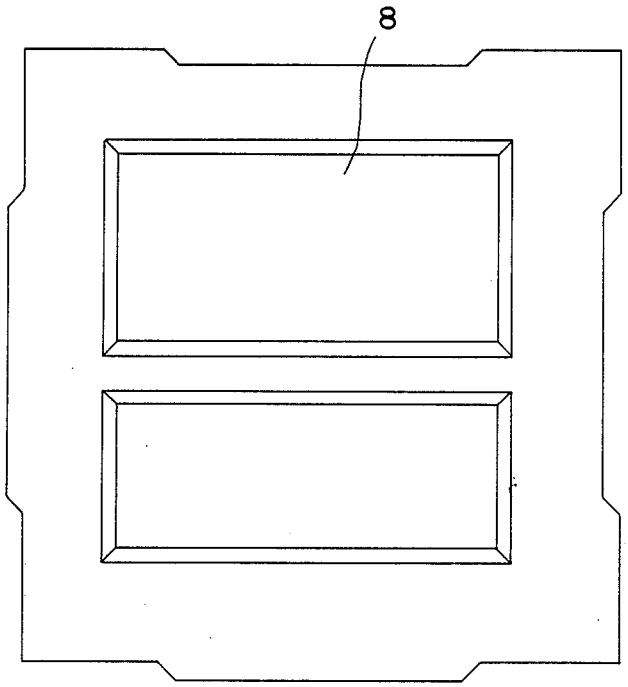
FIG. 6 represents a bottom view of the container.

As shown in the figures, the containers presents a cubic form having lateral faces with cog male/female (1, 1', 2), superior face hollowed (7), and lower face with protrusions (8) for cogging with the superior face of allowing pitchforking for hoisting or lifting with elevators, trolleys or lifters. In the superior face, recessed hanging means are provided (3) and in the center of said superior face a circular opening (6) is further provided allowing access to the internal chamber. This internal chamber is of spherical form (9), and the respective inner wall can be coated in conformity with the material to be contained that can also be liquid.

Advantageously, the container is provided with number plates (4, 5) with at least one of them cashed in the concrete.

Advantageously, said number plates are applied both superiorly and laterally.

Advantageously, the opening of the container (6) is frustumconical in order to be floodgate in hermetic way by the respective plug.

I claim:

1. Ecologic container for pollutant materials, dangerous materials, or both, comprising:

a prefabricated concrete structure in parallelepiped form, having lateral faces, a superior face, and a lower face, and an internal containing chamber as a spheroidal cavity with a superior opening closable by a plug.

2. Ecologic container as claimed in claim 1, wherein said internal containing chamber is coated internally.

3. Ecologic container as claimed in claim 1, wherein on the lateral faces there are lugs or protrusions and recesses for male and female cogging and fitting in association with analogous containers.

4. Ecologic container as claimed in claim 1, wherein:

on the lateral faces there are lugs and recesses for male and female cogging and fitting in association with analogous containers; and on the superior face, there is a recess insertable with corresponding lugs or protrusions on the opposed face of an analogous container.

5. Ecologic container as claimed in claim 1, wherein:

on the lateral faces, there are lugs and recesses for male and female cogging and fitting in association with analogous containers;

on the superior face, there is a recess insertable with corresponding lugs or protrusions on the opposed face of an analogous container, and on the lower face;

at least a couple of recesses for allowing pitchforking with forks of trolleys, elevators or lifters.

6. Ecologic container as claimed in claim 1, wherein at least a couple of cashed rings are disposed laterally in juxtaposition in the superior face of the container.

7. Ecologic container as claimed in claim 1, wherein a plate to allow identification of the material contained is applied on the superior face of the container.

8. Ecologic container as claimed in claim 1, wherein a plate to allow identification of the material contained is applied on a lateral face of the container.

9. Ecologic container as claimed in claim 1, wherein said superior opening is in circular form.

10. Ecologic container as claimed in claim 1, wherein said superior opening is in frustumconical form.

11. Ecologic container as claimed in claim 1, wherein said prefabricated concrete structure is in cubic form.

* * * * *

UNITED STATES PATENT AND TRADEMARK OFFICE

CERTIFICATE OF CORRECTION

PATENT NO. : 4,979,618

DATED : December 25, 1990

INVENTOR(S) : Giovanni Pellegrini Afri

It is certified that error appears in the above-identified patent and that said Letters Patent is hereby corrected as shown below:

On the title page, for the name of the inventor, change "Givoanni" to --Giovanni--.

Column 1, line 5, change "invetion" to --invention--;

line 39, change "reinforce" to --reinforced--;

line 58, after "container" delete the comma (,);

line 67, change "Etc." to --etc.--.

Column 2, line 9, after "tampered" insert --with--;

line 27, change "containers" to --container--;

UNITED STATES PATENT AND TRADEMARK OFFICE

CERTIFICATE OF CORRECTION

PATENT NO. : 4,979,618

DATED : December 25, 1990

INVENTOR(S) : Giovanni Pellegrini Afri

It is certified that error appears in the above-identified patent and that said Letters Patent is hereby corrected as shown below:

Column 2, line 31, change "of" to --or--.

Signed and Sealed this

Third Day of September, 1991

*Attest:*

HARRY F. MANBECK, JR.

*Attesting Officer*

*Commissioner of Patents and Trademarks*